US006832595B2

(12) United States Patent
Klein et al.

(10) Patent No.: US 6,832,595 B2
(45) Date of Patent: Dec. 21, 2004

(54) SELF-CLEANING INTERNAL COMBUSTION ENGINE INTAKE VALVE

(76) Inventors: Jeffrey F. Klein, 8106 Tichenor Point Ct., Millersville, MD (US) 21108; Konstantin Mikhailov, 3637 Chadwick Ct., Pasadena, MD (US) 21122

( * ) Notice: Subject to any disclaimer, the term of this patent is extended or adjusted under 35 U.S.C. 154(b) by 0 days.

(21) Appl. No.: 10/372,704

(22) Filed: Feb. 24, 2003

(65) Prior Publication Data

US 2003/0172895 A1 Sep. 18, 2003

Related U.S. Application Data

(60) Provisional application No. 60/359,611, filed on Feb. 25, 2002.

(51) Int. Cl.[7] ..... F02B 75/02

(52) U.S. Cl. ..... 123/312; 123/198 A; 123/188.4

(58) Field of Search ..... 123/198 A, 188.4, 123/188.3, 188.5, 188.2, 312; 137/242

(56) References Cited

U.S. PATENT DOCUMENTS 3,675,825 A * 7/1972 Morane ..... 222/148

* cited by examiner

*Primary Examiner*—Thomas Denion
*Assistant Examiner*—Zelalem Eshete
(74) *Attorney, Agent, or Firm*—Law Offices of Royal W. Craig

(57) ABSTRACT

A self-cleaning valve for removing hydrocarbon deposits from pressure responsive automatic air intake valves in an internal combustion engine. The self-cleaning valve assembly of the present invention removes soot which naturally accumulates on the surface of the valve as a result of the heat generated by the combustion event when hydrocarbon fuel sources are used. A reciprocating slider is seated within a bushing. The bushing is fluted with small relief passages along its length. The fluted relief passages run more or less parallel to the direction of the movement of the slider, and provide channels for removing soot from the surface of the valve. Repeated closing of the slider hammers soot upwardly into the relief passages, thereby maintaining the valve free of potentially fouling hydrocarbon deposits.

5 Claims, 11 Drawing Sheets

SELF-CLEANING INTERNAL COMBUSTION ENGINE INTAKE VALVE

CROSS-REFERENCE TO RELATED APPLICATION(S)

The present application derives priority from U.S. Provisional application Ser. No. 60/359,611 filed Feb. 25, 2002.

BACKGROUND OF THE INVENTION

1. Field of the Invention

The present invention relates to intake valves, and more particularly to an automatic air intake valve in an internal combustion engine with self-cleaning feature for removing hydrocarbon deposits.

2. Description of the Background

The present invention relates to intake valves used in an internal combustion engine. FIGS. 1–8 diagrammatically depict the cycle of an internal combustion engine. As shown in FIG. 1, the components of the internal combustion engine generally comprises an engine block 10 having a plurality of cylinders 12. Each cylinder 12 houses a piston 14 connected to a crankshaft 16 via a piston rod 18 as is commonly known to those skilled in the art. Each cylinder includes an intake valve 20 for admitting air prior to the compression event, and an exhaust valve 22 for venting exhaust fumes following the compression event. Exhaust valve 22 may alternatively be an exhaust port positioned along a sidewall of cylinder 12 as more fully described in U.S. Pat. No. 6,257,180 to Klein. The particular type of intake valve 20 shown in FIG. 1 is a pressure responsive automatic air intake valve for use in a forced coaxially ventilated two stroke or four power plant. Such a valve opens and closes in response to differences in air pressure between the intake manifold and the combustion chamber (cylinder).

For illustrative purposes, the four stroke engine cycle can be broken down into seven sequential events, each event corresponding to a specific position of the piston 14, intake valve 20 and exhaust valve 22.

As shown in FIG. 1, the cycle begins with piston 14 at the top dead center position within cylinder 12. Both intake valve 20 and exhaust valve 22 are in the closed position.

FIG. 2 shows the second position or "intake" wherein piston 14 travels downwardly through cylinder 12, and intake valve 20 opens allowing air to be inducted into the chamber of cylinder 12.

FIG. 3 represents the next distinct step in the engine cycle wherein piston 14 reaches bottom dead center in cylinder 12 and intake valve 20 closes again.

FIG. 4 shows the "compression" stage wherein piston 14 moves upwardly through cylinder 12 compressing the mixture of air and gas in the cylinder. Both intake valve 20 and exhaust valve 22 remain in the closed position.

FIG. 5 shows the "power" stage in which piston 14 is driven downward once again through chamber 12, until it reaches bottom dead center as shown in FIG. 6. FIG. 7 shows the next sequential stage or the "exhaust" stage wherein piston 14 travels once more upwardly through cylinder 12, and exhaust valve 22 opens allowing the accumulated exhaust gasses to be expelled from the chamber of the cylinder 12. As shown in FIG. 8, at the end of the "exhaust" stage piston 14 reaches top dead center once more, exhaust valve 22 closes, and the engine cycle repeats itself.

The cycle is known as the Otto Cycle and is well known by those skilled in the art as a means for generating power via an internal combustion engine.

The adherence of soot and impurities to the sidewall of the valves and surrounding surfaces is an unavoidable consequence of the combustion of hydrocarbon fuel. Over time, accumulated sootmight obstruct the proper opening and closing of the valve. The object of the instant invention is to overcome this drawback and to provide a self-cleaning valve assembly for removing the potentially fouling soot.

The problem of hydrocarbon build-up in the combustion chamber of engines such as the above is well known. Prior solutions, however, have been directed towards flushing away the accumulated soot deposits. For example, U.S. Pat. No. 6,178,944B I to Kerns et al. teaches a method wherein additional fuel is injected into the combustion chamber, drawn into the intake manifold and subsequently inducted back into the combustion chamber past the intake valve to flush carbon deposits from the intake valve and surrounding surfaces. Unfortunately, the cleaning method of Kerns et al. is inefficient because it requires certain steps in addition to the normal engine cycle. This in turn requires more internal engine parts, and more maintenance.

A second example is shown in U.S. Pat. No. 5,286,264 to Russo, et al. Russo '264 teaches a gasoline detergent additive composition for flushing hydrocarbon deposits from internal engine components. Unfortunately, the detergent is only useful for removing hydrocarbon deposits after they have formed, rather than removing the fouling deposits as they form.

Absent from the prior art is a method for mechanically removing the accumulated hydrocarbon deposits from an engine valve. Accordingly, it would be advantageous to provide a self-cleaning engine valve and valve guide for mechanically removing hydrocarbon deposits. It further be advantageous to provide a self-cleaning engine valve for mechanically removing hydrocarbon deposits using the normal movement of an engine during the cycle of ventilation, compression, and combustion.

SUMMARY OF THE INVENTION

It is, therefore, an object of the present invention to provide a self-cleaning valve assembly for mechanically removing accumulated hydrocarbon deposits from the surface of the valve.

It is another object of the present invention to provide a self-cleaning valve assembly for mechanically removing accumulated hydrocarbon deposits from the valves of an internal combustion engine which uses the movement of the engine during the normal cycle of ventilation, compression, and combustion.

According to the present invention, the above-described and other objects are accomplished by providing a bushing which houses a reciprocating slider valve member. The inner walls of the bushing are fluted with small relief passages which run parallel (more or less) to the direction of the movement of the slider. As soot accumulates in the valve seat and side walls of the slider, it is collected in the flutes when the valve closes. Repeated closing of the valve hammers the soot higher into the fluted relief passages, while the vertical movement of the slider shears any soot which protrudes into its path from the flutes. The soot thereafter mixes with the intake air to be recombusted or wasted along with the portion of incoming air which cools the cylinder.

DETAILED DESCRIPTION OF THE PREFERRED EMBODIMENTS

The improved valve structure of the present invention is herein described in the context of the intake valve 20 shown in the above-described '180 patent (a pressure responsive automatic air intake valve for use in a forced coaxially ventilated two stroke or conventional four stroke power plant). However, those skilled in the art will understand that the improved valve has application wherever particulates pose a valve clogging problem.

Figure 9:
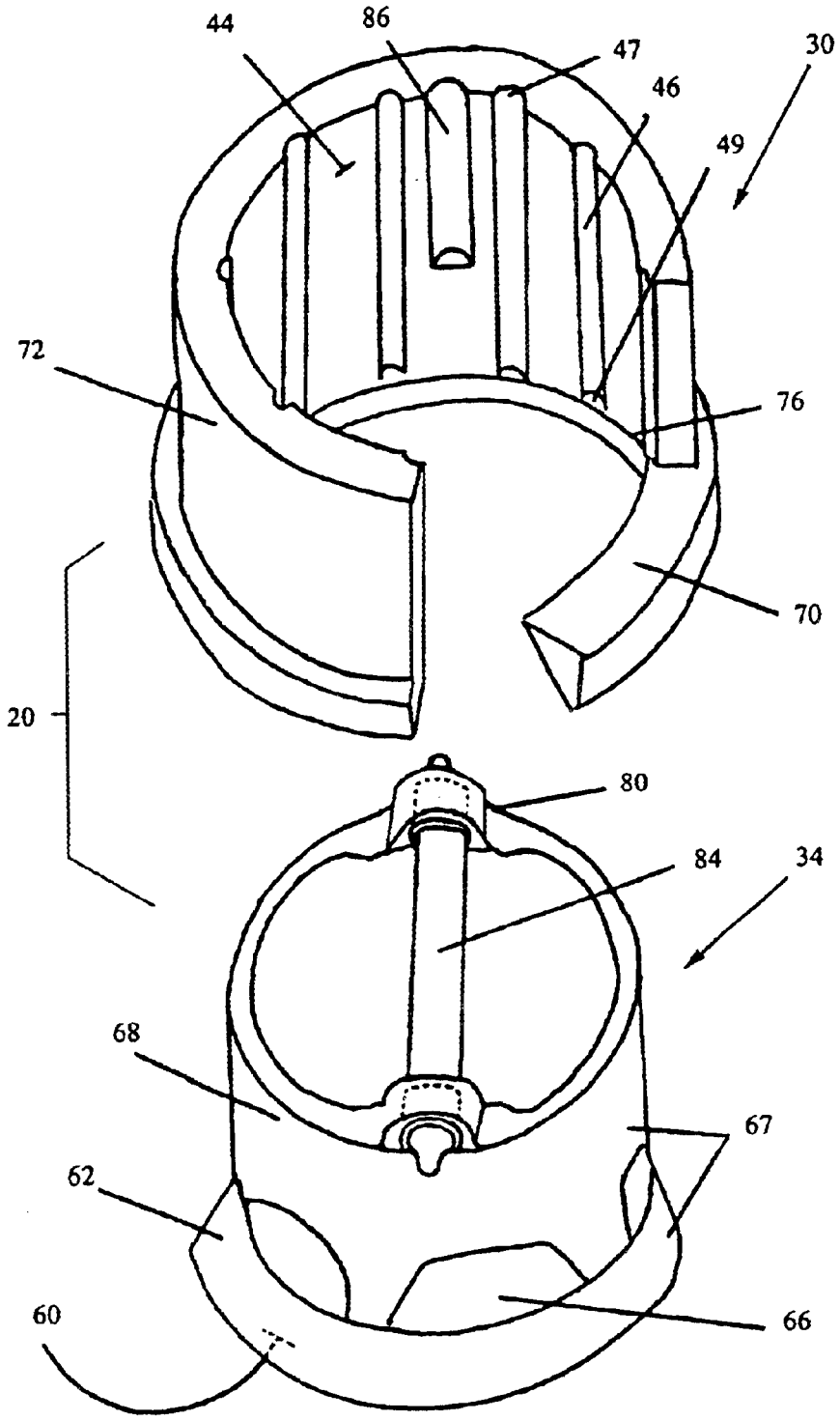
FIG. 9 is an exploded view of the valve guide and valve of the self-cleaning valve of the instant invention.

FIG. 9 is an exploded perspective view of the improved self-cleaning intake valve 20 of the instant invention with a slider 34 (bottom) shown removed from within a valve housing 30.

Valve 20 is configured as a pressure responsive valve which opens automatically in response to a pressure of approximately 1 psi. The valve cycles between an open and closed position in the course of the engine cycle, opening to allow delivery of fresh air into the combustion cylinder, and closing to prevent backflow of uncombusted air as described more fully above.

Valve housing 30 includes a hollow cylindrical bushing 72 with an integral rim 70 at the lower end. The valve housing 30 may be cast integrally as part of a cylinder head, or it may be a separate component as shown which is attached to the cylinder head by external threads as described in the '180 patent. It should be apparent to those skilled in the art that the valve housing 30 may be formed and installed in various other known ways. For example, valve housing 30 may be stamped and press-fit, etc. The rim 70 has an expanded outside diameter and serves as a valve seat for slider 34 as described more fully below.

Figure 10:
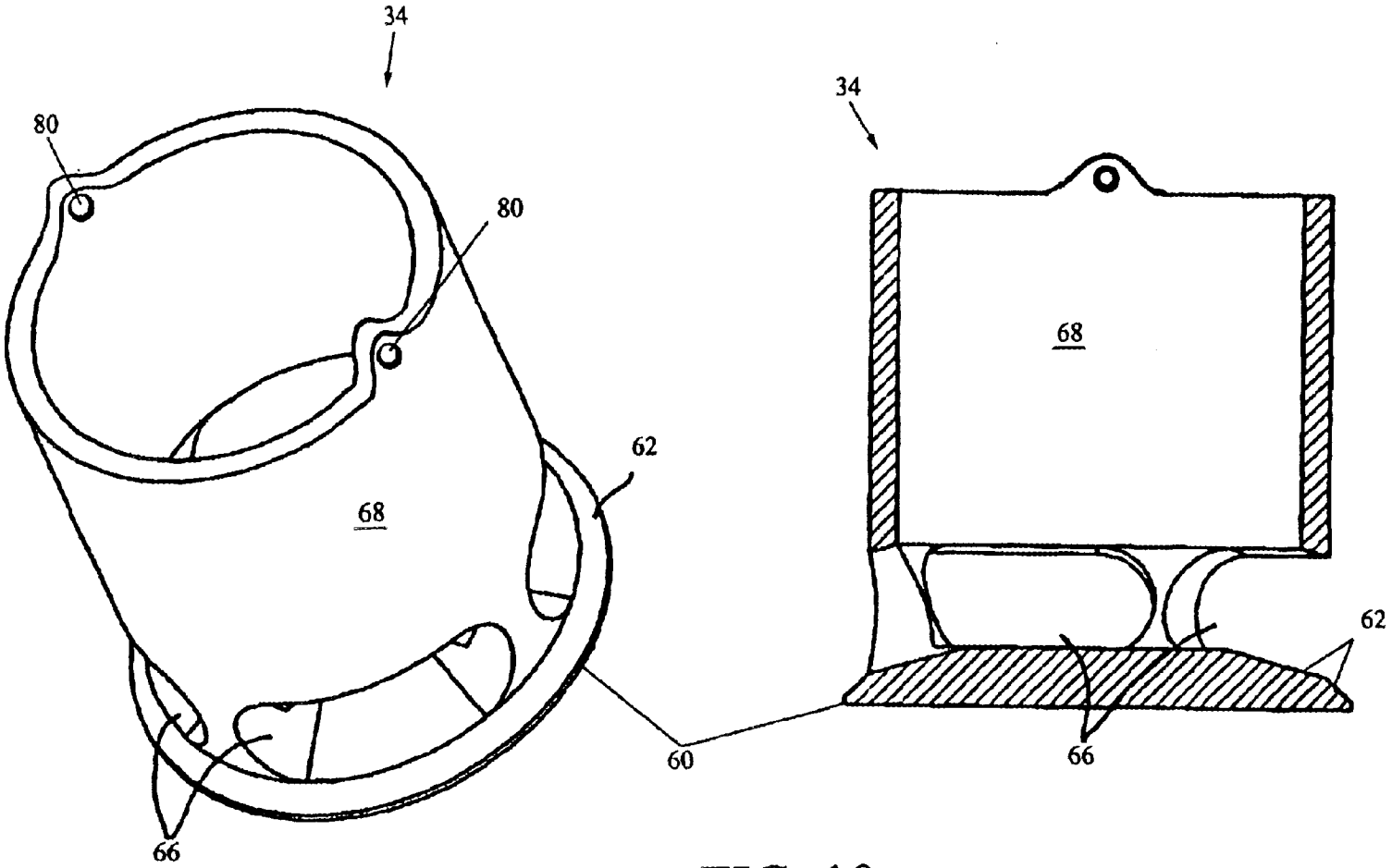
FIG. 10 a composite side perspective view of slider 34 (left) and a side cross-sectional view of slider 34 (right).

Slider 34 is substantially as described in U.S. Pat. No. 6,257,180 to Klein, and is herein seen with reference to FIG. 10, which is a composite side perspective view of slider 34 (left) and a side cross-sectional view of slider 34 (right). Slider 34 comprises an elongate hollow cylinder 68 dimensioned to fit snug, but also slide freely within valve housing 30. The top end of cylinder 68 is open, and the bottom end is closed with a cap 60. Chamfered walls 62 extend upwardly from cap 60 to cylinder 68 thereby joining the two elements. A plurality of openings 66 are provided around the circumference of cylinder 68 immediately adjacent to end cap 60. Openings 66 provide a path of travel for air directed through intake valve 20, as more fully shown in the '180 patent. When valve 20 is fully closed, the end cap 60 of slider 34 rests flush against the rim 70 of valve housing 30, thereby covering openings 66 and sealing the valve closed.

Figure 1:
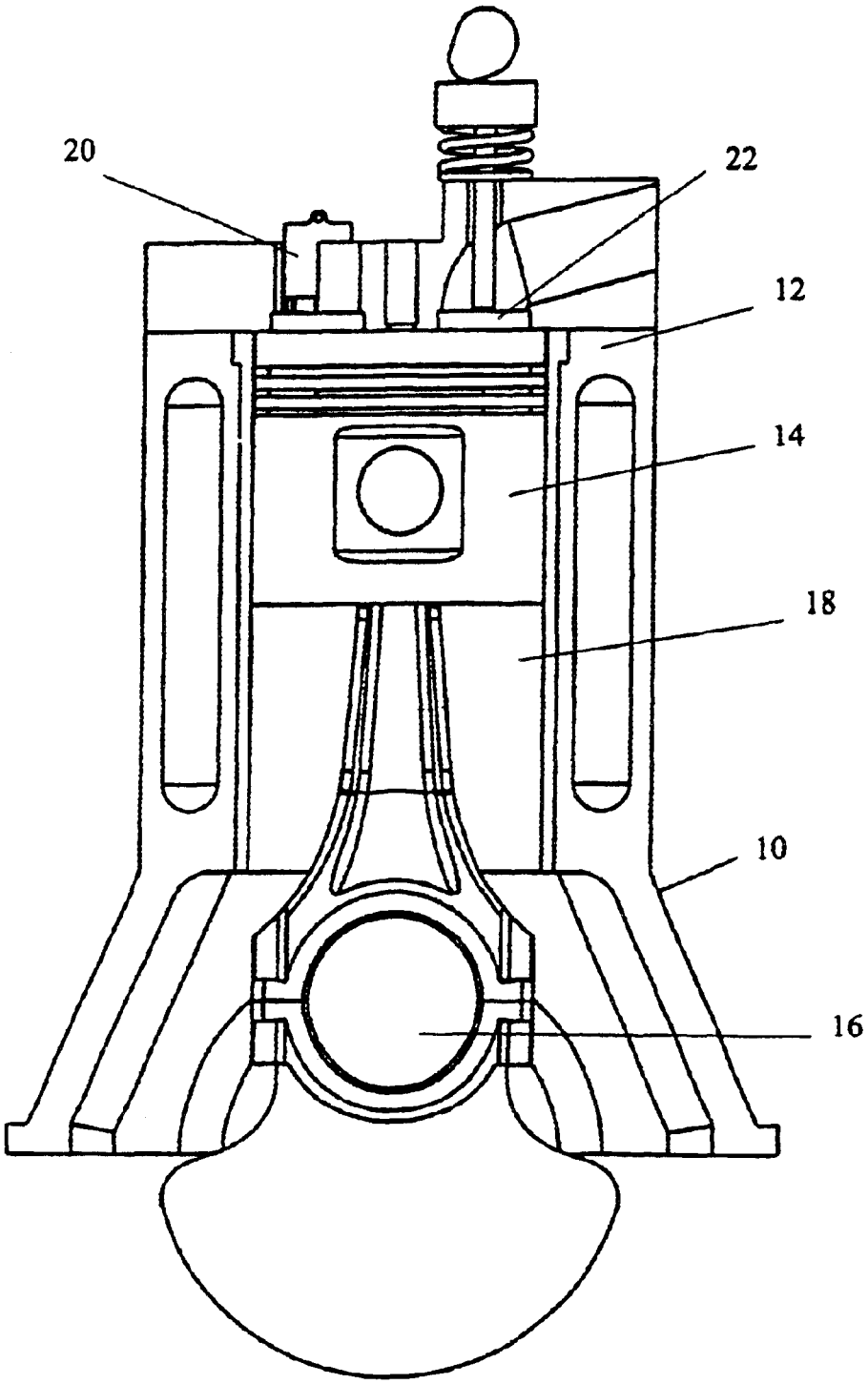
FIG. 1 (Prior Art)
FIGS. 1–8 (Prior Art) are sectional views of an internal combustion engine having a self-cleaning valve of the instant invention wherein the relative positions of the power piston, intake valve, and exhaust valve are shown in the following sequential positions: top dead center; intake; bottom dead center; compression; power; bottom dead center; exhaust; and top dead center.
Figure 2:
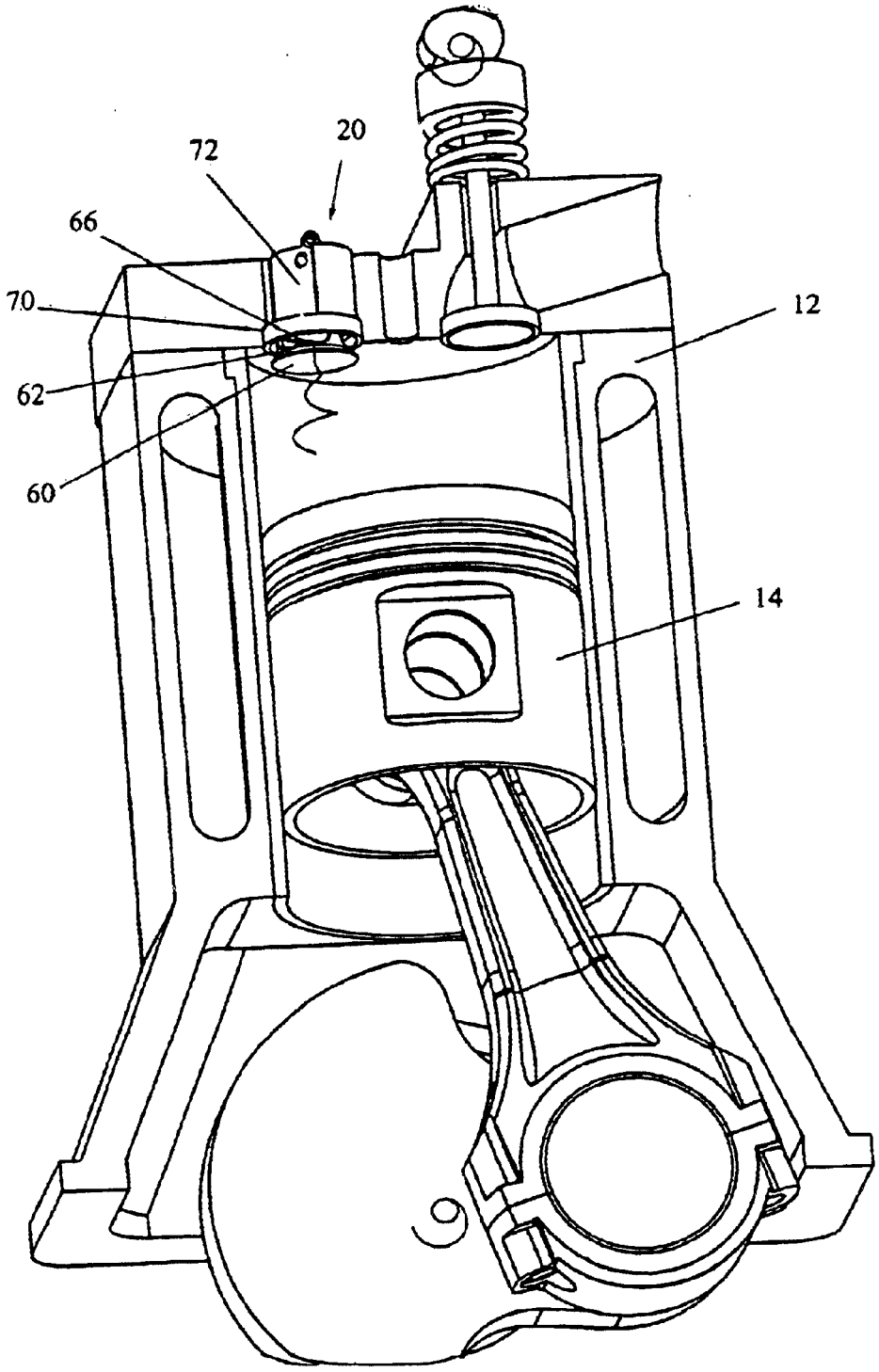
FIG. 2 (Prior Art)
Figure 3:
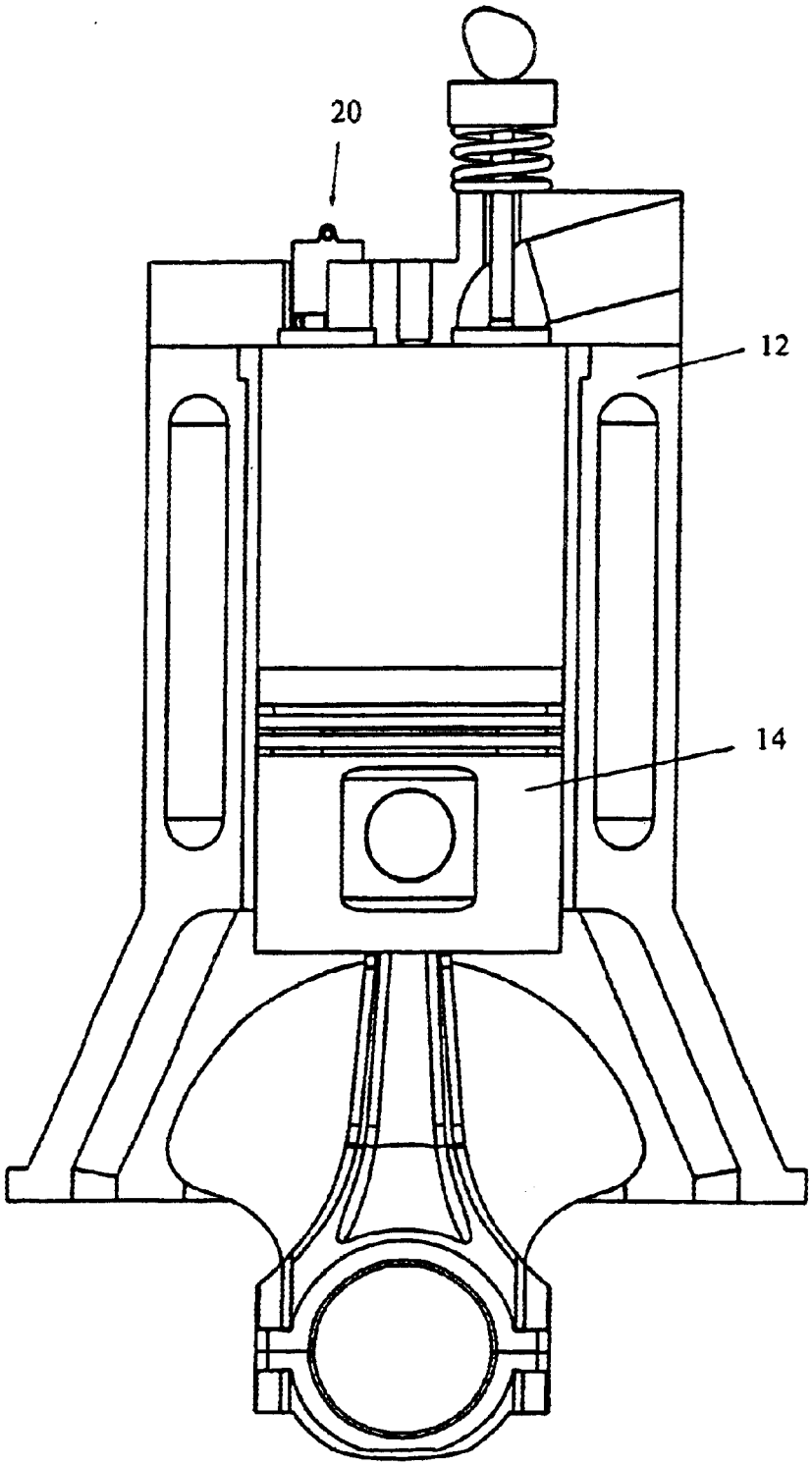
FIG. 3 (Prior Art)
Figure 4:
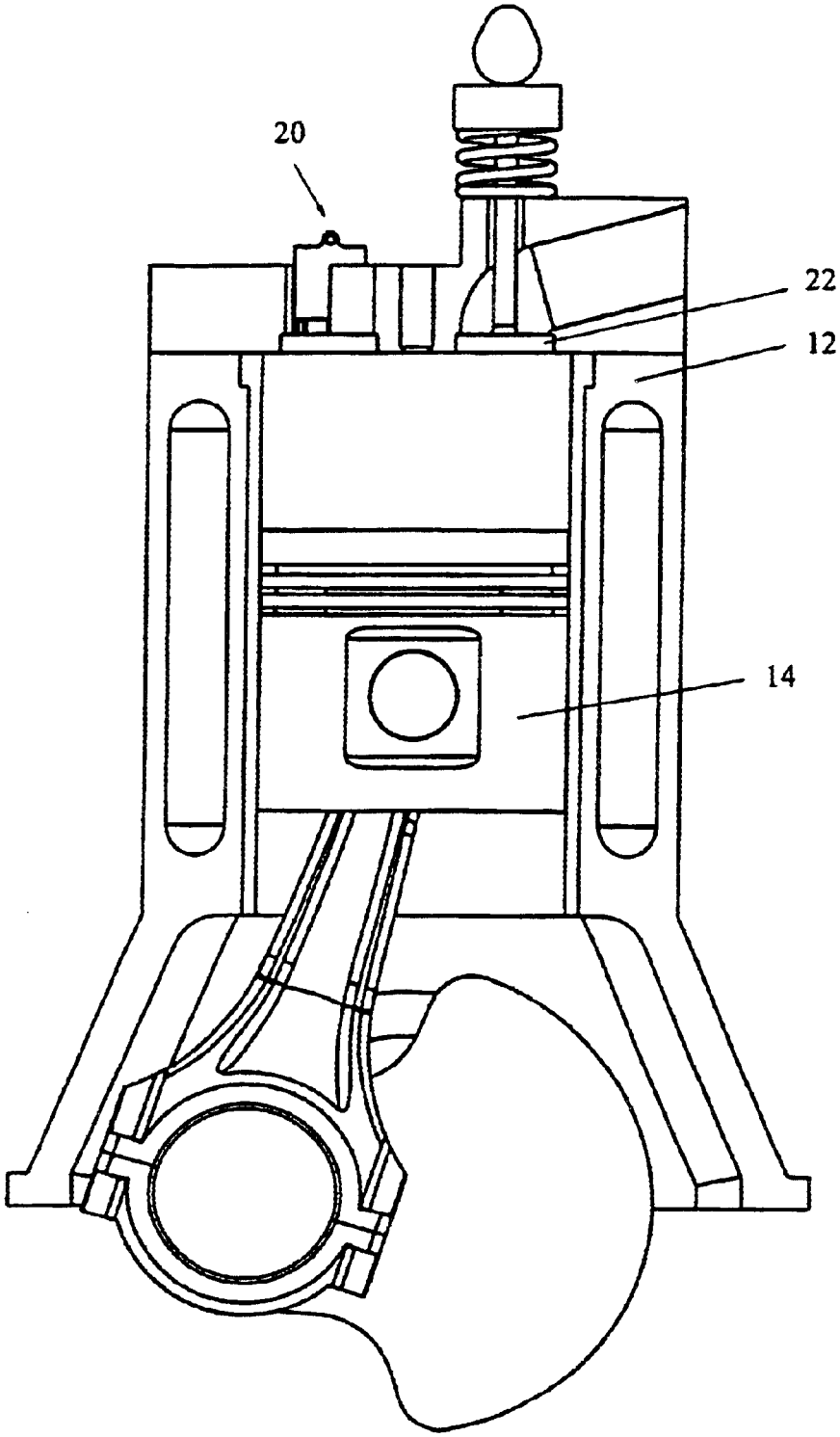
FIG. 4 (Prior Art)
Figure 5:
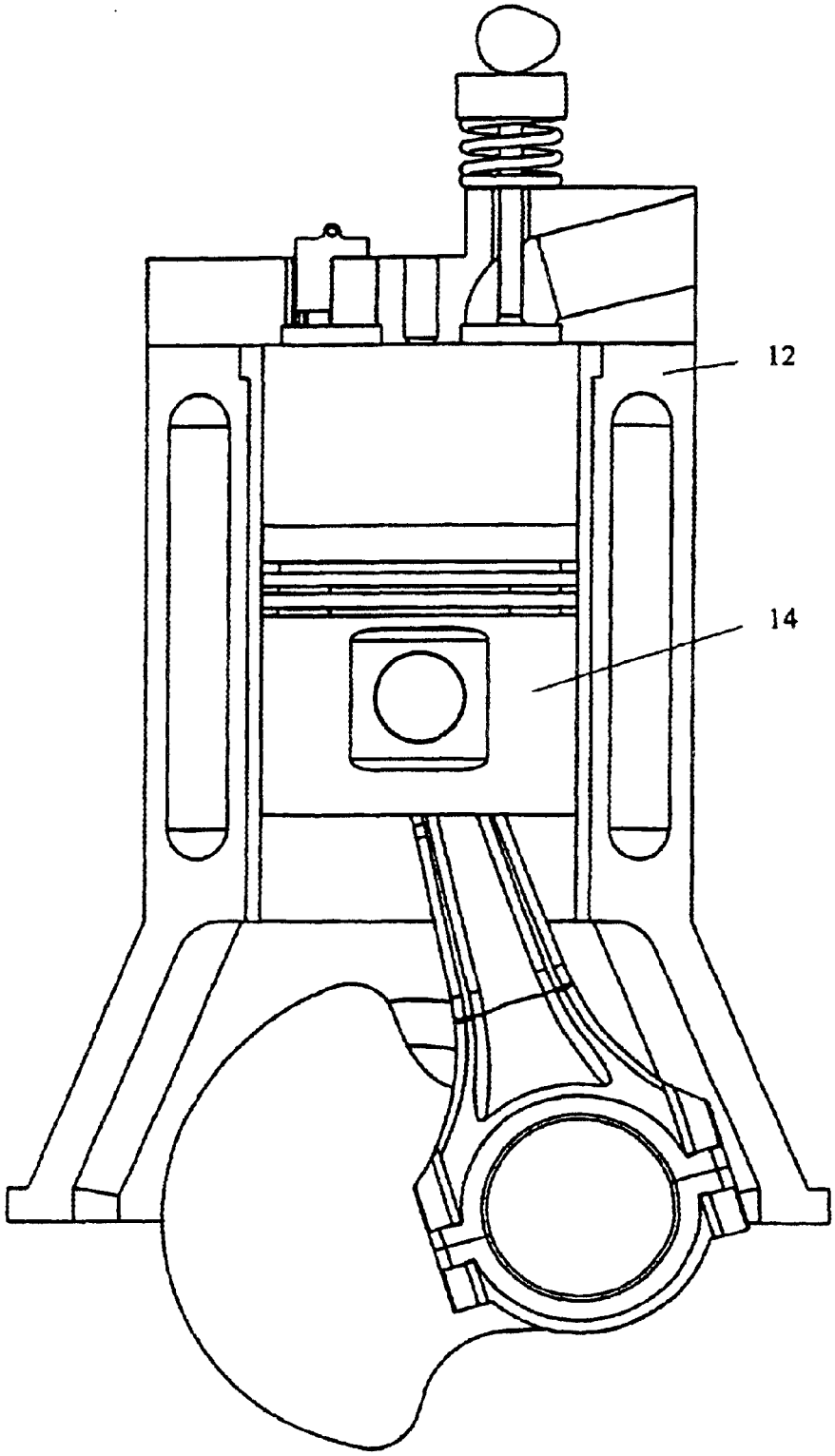
FIG. 5 (Prior Art)
Figure 6:
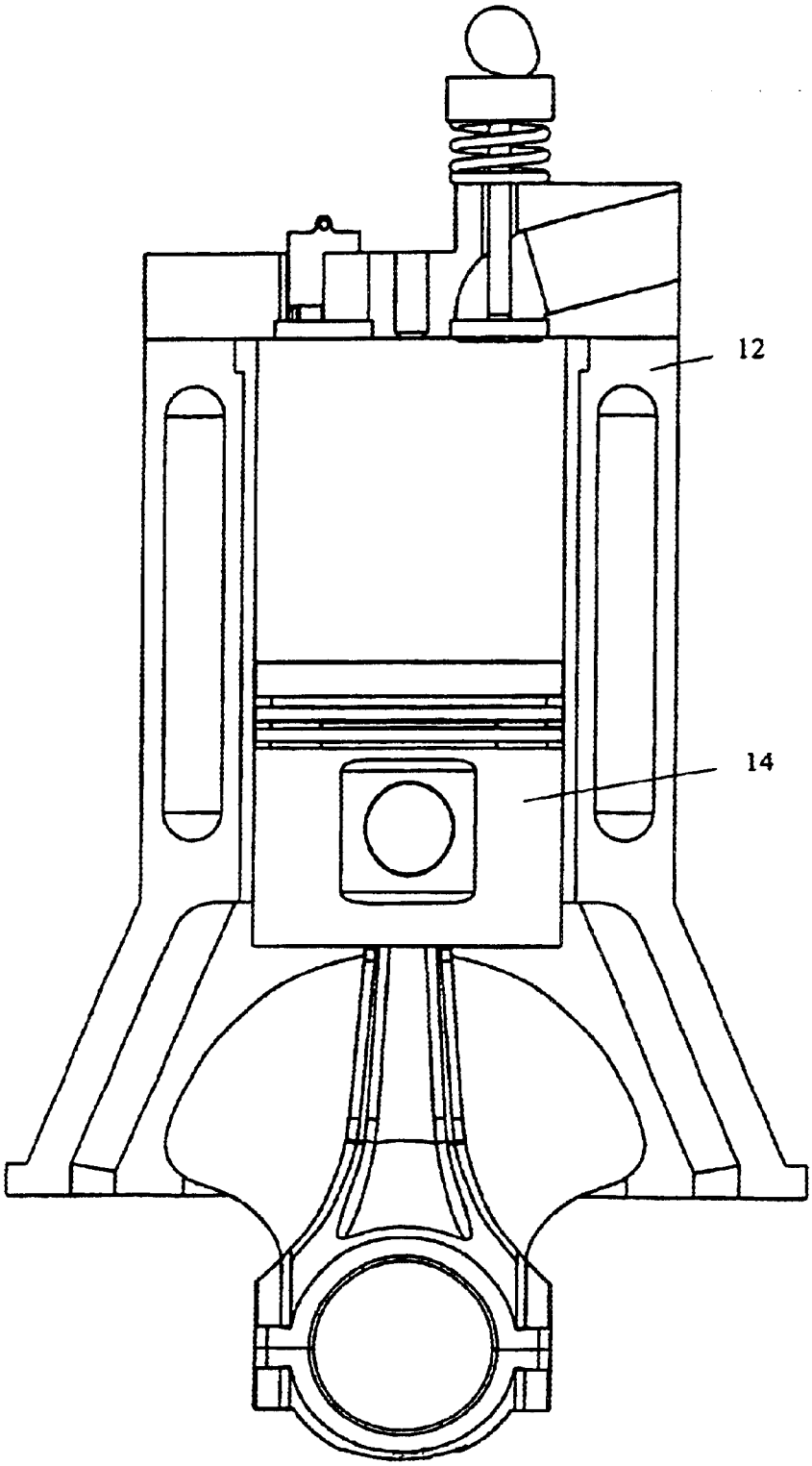
FIG. 6 (Prior Art)
Figure 7:
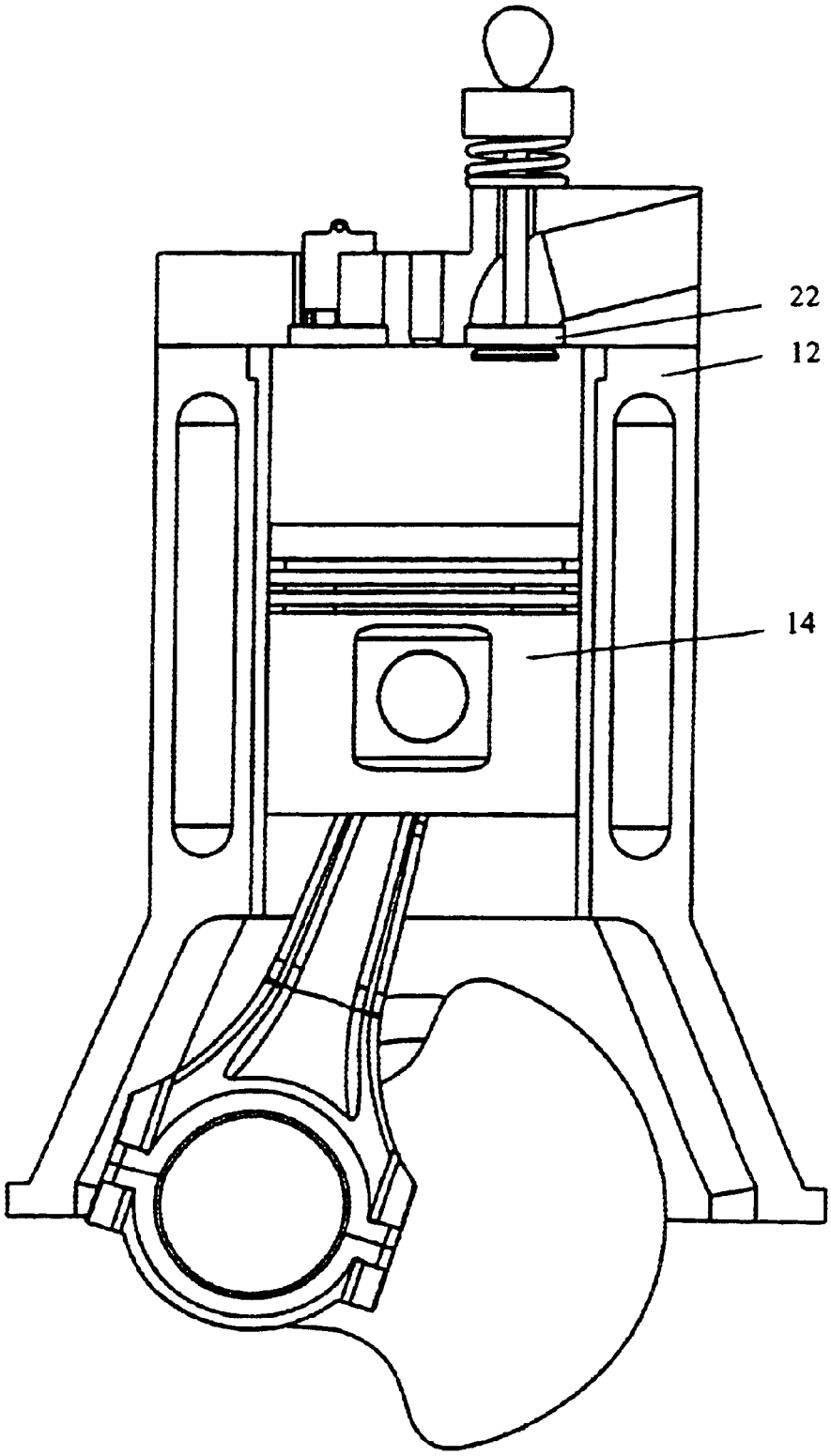
FIG. 7 (Prior Art)
Figure 8:
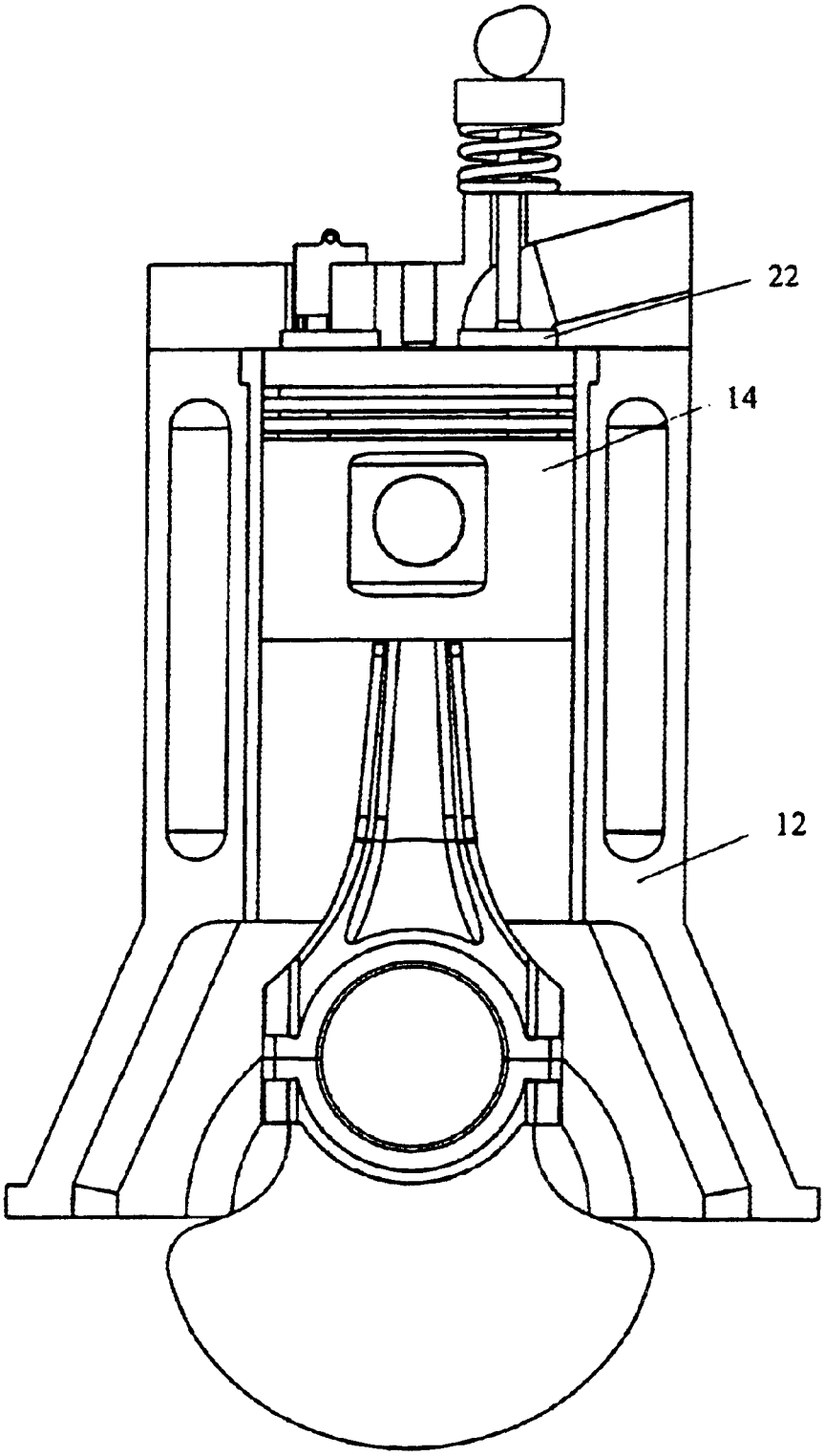
FIG. 8 (Prior Art)

Slider valve member 34 may be provided with a pair of opposing bore holes 80 on the top rim cylinder 68. Bore holes 80 are configured to receive a pin 84 (see FIG. 1) when the valve is assembled. When the slider 34 is inserted within the housing 30, the distal ends of pin 84 are captured within a pair of opposing grooves 86 (one of which is visible in FIG. 9) that are formed on the inner wall 44 of housing 30. Grooves 86 extend approximately to the mid-point of housing 30, thereby allowing slider 34 to partially extend from the bottom of housing 30. This configuration limits the path of travel of slider valve member 34 within valve housing 30, and likewise prevents the inadvertent withdrawal and removal of slider valve member 34 from housing 30 during operation.

Alternatively, one or more slots may be machined into the slider 68 parallel to its direction of movement. One or more dowels may be inserted through the valve guide 72, which will protrude through the slot(s), thereby limiting the distance of travel of the slider 68.

As yet another alternative to the foregoing pin 84 and groove 86 configuration, it is possible to machine a groove, parallel to the direction of valve motion, completely through the wall of the valve 30. A hardened steel pin is then anchored in the cylinder head, through the cylindrical bushing 72 perpendicular to the motion of the slider 34.

Figure 11:
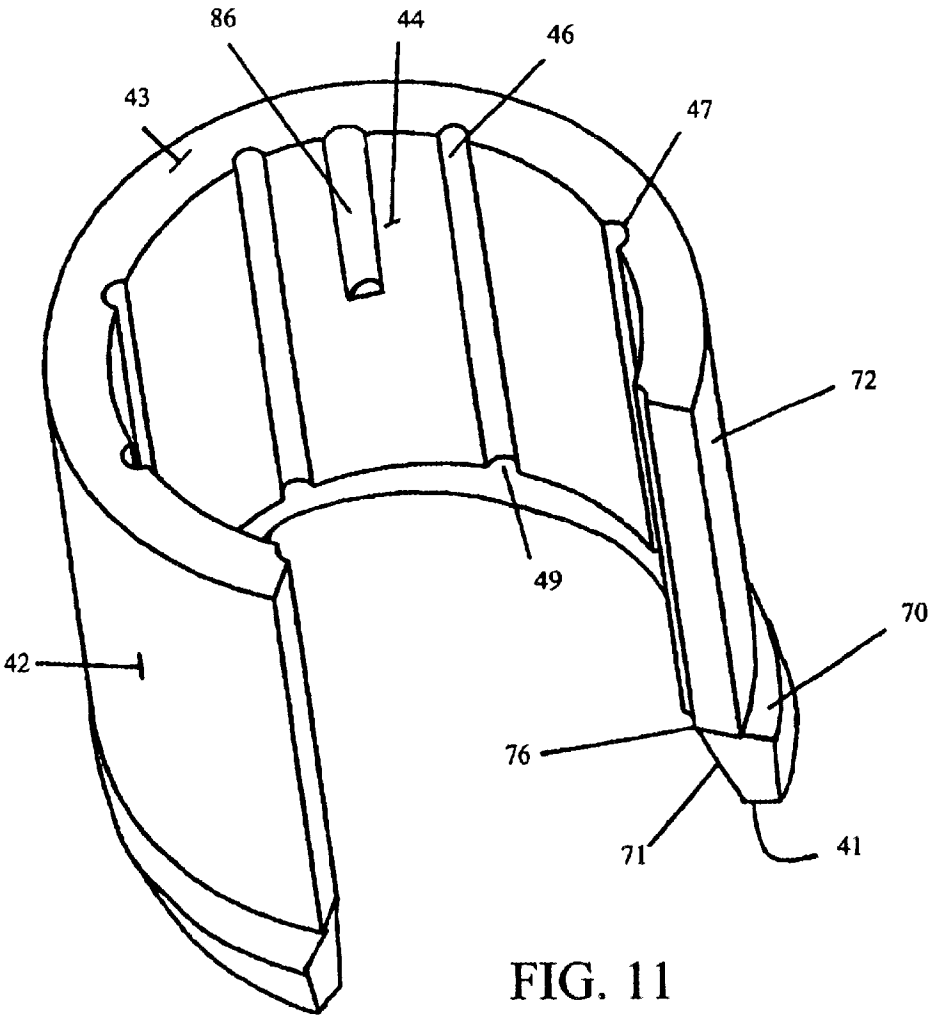
FIG. 11 is a partial sectional view of the bushing of the self-cleaning valve assembly of the present invention showing the fluted relief passages.

Referring now to FIG. 11, valve housing 30 comprises a cylindrical bushing 72 which defines an outer wall 42, an inner wall 44 forming a cylindrical first channel for receiving slider valve member 34, a top edge 43, and a bottom edge 41 that is a hardened valve seat (where the foot of the valve seals the passage into the cylinder head). There is a circular seam 76 at the base of inner wall 44 (where bushing 72 meets rim 70 ), and below seam 76 the inner face 71 of rim 70 flares outwardly to accommodate cap 68. Top edge 43 is defined by the top of bushing 72, and bottom edge 41 is defined by the bottom face of rim 70. In accordance with the present invention, inner wall 44 is fluted with a plurality of parallel second channels 46 which run from top edge 43 to seam 76. The second channels 46 form shallow elongate grooves, preferably with semi-circular cross sections in inner wall 44, open to the hollow interior of housing 30. The second channels 46 are preferably evenly spaced around the perimeter of inner wall 44. The top end of each channel 46 is open, forming a first semi-circular aperture 47 in top edge 43. The bottom end of each channel 46 is likewise open, forming a second semi-circular aperture 49 at seam 76.

The operation of the valve 20 is best understood with reference to the exploded view of FIG. 9. Inner wall 44 of housing 30 lightly contacts outer wall 67 of slider 34. Soot adhering to outer wall 67 is mechanically scraped off and collected in apertures 49 at the base of housing 30. As slider 34 continues to move upwardly to a closed position within housing 30, the soot is pushed farther upward into channels 46. The force of slider 34 closing against valve housing 30 hammers the soot upward into channels 46. Each repetitive closing of slider 34 collects more soot, and forces the accumulated soot higher and higher into channels 46. When the soot reaches the top of channel 46, it is expelled through aperture 47, and thereafter falls into the hollow center of slider valve member 34, where it is inducted into compression chamber of cylinder 12 in the subsequent intake cycle.

If the soot extends beyond the arc shaped recesses of channel 46 into the hollow center of housing 30, it is sheared off by slider 34 as it closes within valve housing 30. The sheared off soot drops into the hollow center of slider 34, where it is inducted into compression chamber of cylinder 12 in the subsequent intake or ventilation cycle.

The self-cleaning mechanism of the instant invention maintains the valve in an operational state nearly free of potentially fouling soot. Further, the mechanism disclosed herein is highly efficient because it cleans the valve using the existing cycle of opening and closing, and thereby eliminates the need for additional movement within the engine or the use of detergent additives. Finally, the self-cleaning mechanism of the present invention continuously cleans the valve as soot accumulates (as distinguished from detergents which are only useful for rinsing away accumulated deposits), thereby maintaining optimal engine performance.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

We claim:

1. A self-cleaning valve for an internal combustion engine, comprising:

a housing configured as an elongate hollow bushing having a first end and a second end, and having an inner wall forming a cylindrical first channel for receiving a slider valve member, said inner wall further defined by a plurality of second channels extending from said first end to said second end; and said slider valve member configured for reciprocating movement within said bushing, said slider valve member further comprising a hollow elongate cylinder having an open first end and a closed second end;

whereby hydrocarbon deposits collect on said cylindrical slider valve member during operation of said internal combustion engine and, whereby each time said slider valve reciprocates within said housing said hydrocarbon deposits are scraped from said slider valve, forced through said plurality of second channels and expelled.

2. The self-cleaning valve as in claim 1, wherein said plurality of second channels are all substantially parallel.

3. The self-cleaning valve as in claim 2, wherein each of said second channels comprises a recess formed in said inner wall; said recess having a semi-circular cross section opening to an interior of said housing, said second channel recesses each having a first aperture at one end and a second aperture at another end to facilitate egress and ingress of deposits collected from said slider valve member.

4. The self-cleaning valve as in claim 3, wherein said second channels are all substantially evenly spaced.

5. The self-cleaning valve as in claim 4, wherein said slider valve member is configured to fit snug, but also slide freely within said first channel of said housing; wherein said hydrocarbon deposits are scraped off said slider valve member by said second end of said housing as the slider valve slides into said first channel; and wherein said hydrocarbon deposits are collected at said second end of said housing and then forced into said second apertures of said plurality of second channels, through said plurality of second channels and out said first apertures, as said slider valve reciprocates, thereby cleaning said slider valve member.

* * * * *